US005329304A

United States Patent [19]

Koizumi et al.

[11] Patent Number: 5,329,304

[45] Date of Patent: Jul. 12, 1994

[54] REMAINING INK DETECTING DEVICE AND INK JET HEAD CARTRIDGE

[75] Inventors: Ryoichi Koizumi; Asao Saito, both of Yokohama, Japan

[73] Assignee: Canon Kabushiki Kaisha, Tokyo, Japan

[21] Appl. No.: 851,129

[22] Filed: Mar. 16, 1992

Related U.S. Application Data

[63] Continuation of Ser. No. 668,690, Mar. 7, 1991, abandoned, which is a continuation of Ser. No. 439,865, Nov. 21, 1989, abandoned.

[30] Foreign Application Priority Data

Nov. 22, 1988 [JP] Japan ..... 63-293627
Nov. 8, 1989 [JP] Japan ..... 1-288736

[51] Int. Cl.[5] ..... B41J 2/175

[52] U.S. Cl. ..... 347/7; 73/304 R; 346/76 PH

[58] Field of Search ..... 346/140 R, 76; 73/304 R, 304 C; 101/364, 366, DIG. 45

[56] References Cited

U.S. PATENT DOCUMENTS

| | | | |
|---|---|---|---|
| 4,183,029 | 1/1980 | Isayama et al. | 346/140 R |
| 4,202,267 | 5/1980 | Heinzl et al. | 346/140 R |
| 4,313,124 | 1/1982 | Hara | 346/140 R |
| 4,345,262 | 8/1982 | Shirato et al. | 346/140 R |
| 4,415,886 | 11/1983 | Kyogoku et al. | 340/618 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,636,814 | 1/1987 | Terasawa | 346/140 R |
| 4,719,475 | 1/1988 | Kiyohara et al. | 346/140 R |
| 4,723,129 | 2/1988 | Endo et al. | 346/1.1 |
| 4,740,796 | 4/1988 | Endo et al. | 346/1.1 |
| 4,782,754 | 11/1988 | Pohlig | 346/140 R |
| 5,070,346 | 12/1991 | Mochizuki et al. | 346/140 R |
| 5,162,817 | 11/1992 | Tajika et al. | 346/140 R |

FOREIGN PATENT DOCUMENTS

| | | |
|---|---|---|
| 0370765 | 5/1990 | European Pat. Off. . |
| 2-348822 | 11/1977 | France . |
| 59-123670 | 7/1984 | Japan . |
| 59-138461 | 8/1984 | Japan . |
| 63-158262 | 7/1988 | Japan . |

*Primary Examiner*—Benjamin R. Fuller
*Assistant Examiner*—J. Barlow
*Attorney, Agent, or Firm*—Fitzpatrick, Cella, Harper & Scinto

[57] ABSTRACT

A device for detecting a quantity of remaining ink includes first and second electrodes provided in an ink supply passage which connects an ink tank for storing an ink to a recording head for emitting the ink, and a detection means for detecting a resistance between the first and second electrodes. The second electrode is provided in the ink supply passage in an area relatively close to the recording head, whereas the first electrode is provided in the ink supply passage in an area relatively far from the recording head with the second electrode therebetween. The second electrode is maintained at the same potential as that of a substrate which constitutes the recording head and on which emission energy generating elements driven to emit the ink are disposed, whereas the first electrode is maintained at a potential different from that of the second electrode. Consequently, the amount of remaining ink can be detected by measuring changes in the resistance between the first and second electrodes.

23 Claims, 6 Drawing Sheets

REMAINING INK DETECTING DEVICE AND INK JET HEAD CARTRIDGE

This application is a continuation of application Ser. No. 07/668,690 filed Nov. 7, 1991, now abandoned, which is a continuation of application Ser. No. 07/439,865, filed Nov. 21, 1989, now abandoned.

BACKGROUND OF THE INVENTION

1. Field of the Invention

The present invention relates to a device for detecting a quantity of remaining ink, and more particularly, to a remaining ink detecting device for use in an ink jet recording apparatus for forming an image by emitting an ink droplet in response to a predetermined signal input.

The present invention further relates to an ink jet head cartridge with such a remaining ink detecting device incorporated therein.

The present invention further relates to an ink jet recording apparatus with such a cartridge mounted thereon.

2. Related Background Art

Ink, which is used, for example, in an ink jet recording apparatus for forming a desired high density image by emitting ink as droplets, is generally stored in a predetermined ink reservoir means, such as an ink cartridge. Various types of devices for detecting the level of residual ink stored in this reservoir means have been proposed.

One of the most commonly employed remaining ink detecting devices is designed to determine whether or not the amount of residual ink is less than a predetermined value on the basis of resistance detected in accordance with the quantity of residual ink existing between two electrodes.

Generally, recording heads mounted on the ink jet recording apparatuses are manufactured in the same manner as that in which semiconductor devices have been manufactured. Such recording heads are composed of a substrate made of silicon or the like and a member which forms ink passageways when it is attached to the substrate. On the substrate are disposed emission energy generating elements, such as electrothermal energy conversion elements, and function elements for driving these conversion elements, such as transistors and diodes. Ink is subjected to heat generated by the electrothermal energy conversion elements in the ink passageway.

FIG. 1 shows an equivalent circuit with electrical characteristics equivalent to those of the circuit for driving the above-described recording head. This driving circuit is designed to drive a recording head having 32 head ink outlets and 32 ink passageways which respectively communicate with these outlets. Individual ink passageways have corresponding electrothermal energy conversion elements R1 to R32, and transistors T1 to T32 which serve as switching elements.

FIG. 2 shows an equivalent circuit of the above-described remaining ink detecting device which is employed in a case where the above-described driving circuit is disposed on the substrate. In FIG. 2, reference numerals 1 and 2 denote electrodes for detecting resistance in accordance with the quantity of remaining ink. A reference numeral 3 denotes an electrode representing the substrate which forms the ink passageways of the above-described recording head and on which the driving circuit shown in FIG. 1 is deposited. A predetermined voltage or current is applied between the electrodes 1 and 2.

More specifically, between the electrodes 1 and 2, the ink flows stably, whereas between the electrodes 2 and 3, ink is affected by the vibrations caused by the discharge of ink and readily becomes unstable. Resistance $R_{1\text{-}2}$ and resistance $R_{2\text{-}3}$representing the quantity of remaining ink respectively exist between the electrodes 1 and 2 and between the electrodes 2 and 3.

In the above-described circuit configuration, since the electrode 3 is floating and has infinite resistance, no current I flows between the electrodes 2 and 3. In consequence, the resistance detected by this remaining ink detecting device is determined only by the resistance $R_{1\text{-}2}$ existing between the electrodes 1 and 2, and stable and accurate detection of the quantity of remaining ink can thus be performed.

For the purpose of meeting the demands for a reduction in size and simplification of the structure of recording heads and those for reduction in failures which occur during their manufacture, recording heads of the type in which electrothermal energy conversion elements and function elements such as switching transistors are disposed on the same substrate and are matrix driven have been developed and used recently. FIG. 3 shows an example of a driving circuit for such a recording head. Whereas the circuit shown in FIG. 1 has 32 switching elements $T_1$ to $T_{32}$, the circuit shown in FIG. 3 employs only 12 switching elements $T_{a1}$ to $T_{a4}$ and $T_{b1}$ to $T_{b8}$ to drive 32 electrothermal energy conversion elements $R_1$ to $R_{32}$.

However, in the recording head which employs this matrix driving method, the individual components are disposed at a high density, and this increases the possibility of a parasitic current flowing between adjacent diode cells in diodes $D_1$ to $D_{32}$.

More specifically, in the matrix driving method, $(m \times n)$ segments of electrothermal energy conversion elements are driven by using m block control terminals and n segment control terminals. FIG. 4A is a cross-sectional view of diodes employed in such a matrix driving method.

These diodes are driven in the manner described below. Although FIG. 4A shows only two diodes (cells), 32 diodes are, for example, disposed in a matrix in an actual recording head, as stated above.

Here, driving of electrothermal energy conversion elements RH1 and RH2, which form two segments in the same group, will be described.

When the electrothermal energy conversion element RH1 is to be driven, a switch G1 is first turned on to select the group, and a switch S1 is then turned on to select the electrothermal energy conversion element RH1. Turning of these switches causes a diode cell SH1 to be positively biased, supplying current to and thereby generating heat in the electrothermal energy conversion element RH1. This thermal energy generated changes the state of the liquid, thus generating a bubble and resulting in the emission of liquid from the outlet.

Similarly, the electrothermal energy conversion element RH2 is driven by selectively turning on switches G1 and S2 and thereby driving a diode cell SH2.

Since the individual diode cells SH1 and SH2 connected to the electrothermal energy conversion elements RH1 and RH2 are formed on the same substrate, the substrate is grounded, as shown in FIG. 4B, in order to electrically isolate the diodes.

In a case where the substrate is a N type Si substrate, the substrate is biased such that it has the highest potential, so as to electrically isolate the diodes.

However, in the case of a P type substrate which is grounded, the electrode 3 shown in FIG. 2, which represents the substrate, is not floating, but is grounded. In consequence, a resistance $R_{2\text{-}3}$affects the resistance detected by the circuit shown in FIG. 2, and the detected value is therefore not determined only by the resistance $R_{1\text{-}2}$. As a result, the quantity of ink detected by measuring the resistance between the electrodes 1 and 2 is affected by the ink existing between the electrodes 2 and 3, and an accurate detection of the quantity of remaining ink is thus prevented.

Furthermore, bubbles may be generated as the gas dissolved in the ink changes with time, and such bubbles are easily attached to the above-described electrodes. These electrodes with bubbles attached thereto also prevent accurate detection of resistance.

SUMMARY OF THE INVENTION

In view of the aforementioned problems of the related art, an object of the present invention is to provide a remaining ink detecting device which enables errors which occur in the ink resistance measurements to be eliminated to ensure stable and accurate detection of the amount of remaining ink. This is accomplished either by setting the potential of a predetermined electrode in two electrodes to a value which is the same as that of a substrate thereby preventing a detection current from flowing in a portion where ink flows unstably or by disposing two electrodes such that a resistance between the electrode 3 representing the substrate and the other electrode 1 having a potential different from that of the electrode 3 is sufficiently large when compared with the ink resistance to be measured.

It is preferable for the above-described resistance $R_{1\text{-}3}$ between the electrode 3 and the electrode 1 and the resistance between the electrodes 1 and 2, i.e., the ink resistance $R_{1\text{-}2}$ to be measured, to have a relation expressed by $R_{1\text{-}3}/R_{1\text{-}2}>5$.

Another object of the present invention is to provide an ink jet head cartridge with the aforementioned stable and accurate remaining ink detection means mounted thereon which is capable of preventing failures from occurring during the emission of ink caused by the absence of ink and which therefore exhibits excellent ink emission characteristics.

Another object of the present invention is to provide an ink jet recording apparatus which is capable of excellent recording by using the aforementioned ink jet head cartridge on which the ink level detection means is mounted and which exhibits excellent ink emission characteristics.

In order to achieve the above-described objects, there is provided, according to one aspect of the present invention, a device for detecting a quantity of remaining ink, which comprises first and second electrodes provided in an ink supply passage which connects an ink tank for storing an ink to a recording head for emitting the ink, and a detection means for detecting a resistance between the first and second electrodes. The second electrode is provided in the ink supply passage in an area relatively close to the recording head, whereas the first electrode is provided in the ink supply passage in an area relatively far from the recording head with the second electrode therebetween. The second electrode is maintained at the same potential as that of a substrate which constitutes the recording head and on which emission energy generating elements driven to emit the ink are disposed, whereas the first electrode is maintained at a potential different from that of the second electrode. In consequence, the amount of remaining ink can be detected by measuring changes in the resistance between the first and second electrodes.

There is provided, according to another aspect of the present invention, an ink jet head cartridge which comprises a recording head portion composed of a substrate on which ink emission energy generating elements are disposed, an ink tank portion for storing an ink to be supplied to the recording head portion, an ink supply passage through which the ink is supplied from the ink tank portion to the recording head portion, and a residual ink detecting means part of which is provided in the ink supply passage for detecting the amount of remaining ink. The residual ink detecting means includes first and second electrodes and a detecting means for detecting a resistance between the electrodes. The second electrode is provided in the ink supply passage in an area relatively close to the recording head portion, whereas the first electrode is provided in the ink supply passage in an area relatively far from the recording head with the second electrode therebetween. The second electrode is maintained at the same potential as that of the substrate, whereas the first electrode is maintained at a potential different from that of the second electrode.

There is provided, according to another aspect of the present invention, an ink jet recording apparatus which comprises: an ink jet head cartridge including a recording head portion composed of a substrate on which ink emission energy generating elements are disposed, an ink tank portion for storing an ink to be supplied to the recording head portion, an ink supply passage through which the ink is supplied from the ink tank portion to the recording head portion, and first and second electrodes provided in the ink supply passage for detecting the amount of remaining ink; a means for detecting a resistance between the first and second electrodes; and a carriage provided in such a manner as to be movable with the ink jet head cartridge mounted thereon. The second electrode is provided in the ink supply passage in an area relatively close to the recording head portion, whereas the first electrode is provided in the ink supply passage in an area relatively far from the recording head with the second electrode therebetween. The second electrode is maintained at the same potential as that of the substrate, whereas the first electrode is maintained at a potential different from that of the second electrode.

There is provided, according to another aspect of the present invention, a device for detecting an amount of remaining ink which comprises first and second electrodes provided in an ink supply passage which connects an ink tank for storing an ink to a recording head for emitting the ink, and a detection means for detecting a resistance between the first and second electrodes. The first and second electrodes are disposed such that a resistance $R_{1\text{-}3}$ between the first electrode having a potential different from that of a substrate which constitutes the recording head and the substrate is sufficiently larger than an ink resistance $R_{1\text{-}2}$between the first and second electrodes which is obtained when the ink is filled therebetween, and that the resistance $R_{1\text{-}3}$ and $R_{1\text{-}2}$ have a relation expressed by $R_{1\text{-}3}/R_{1\text{-}2}>5$. In consequence, the amount of remaining ink is detected by measuring changes in the resistance between the first and second electrodes.

There is provided, according to another aspect of the present invention, a device for detecting an amount of remaining ink which comprises first and second electrodes provided in an ink supply passage which connects an ink tank for storing an ink to a recording head for emitting the ink, and a detection means for detecting a resistance between the first and second electrodes. The first and second electrodes are disposed in the ink flow passage such that a resistance $R_{1-3}$ between the first electrode having a potential different from that of a substrate which constitutes the recording head and the substrate is sufficiently larger than an ink resistance $R_{1-2}$ between the first and second electrodes which is obtained when the ink is filled therebetween, and that the resistances $R_{1-3}$ and $R_{1-2}$ have a relation expressed by $R_{1-3}/R_{1-2}>5$. In consequence, the amount of remaining ink is detected by measuring changes in the resistance between the first and second electrodes.

There is provided, according to another aspect of the present invention, an ink jet recording apparatus which comprises: an ink jet head cartridge including a recording head portion composed of a substrate on which ink emission energy generating elements are disposed, an ink tank portion for storing an ink to be supplied to the recording head portion, an ink supply passage through which the ink is supplied from the ink tank portion to the recording head portion, and first and second electrodes provided in the ink supply passage for detecting the amount of remaining ink; and a carriage provided in such a manner as to be movable with the ink jet head cartridge mounted thereon. The first and second electrodes are disposed in the ink flow passage such that a resistance $R_{1-3}$ between the first electrode having a potential different from that of a substrate which constitutes the recording head and the substrate is sufficiently larger than an ink resistance $R_{1-2}$ between the first and second electrodes which is obtained when the ink is filled therebetween, and that the resistances $R_{1-3}$ and $R_{1-2}$ have a relation expressed by $R_{1-3}/R_{1-2}>5$. In consequence, the amount of remaining ink is detected by measuring changes in the resistance between the first and second electrodes.

There is provided, according to another aspect of the present invention, a device for detecting the amount of remaining ink, which comprises: first and second electrodes provided in an ink supply passage which connects an ink tank for storing an ink to a recording head for emitting the ink, said first and second electrodes being provided an area where the cross-section of the ink supply passage is decreased, and a detection means for detecting a resistance between the first and second electrodes. The second electrode is provided in the ink supply passage in an area relatively close to the recording head, whereas the first electrode is provided in the ink supply passage in an area relatively far from the recording head with the second electrode therebetween.

In the present invention, changes in the resistance between the first and second electrodes can be detected by detecting changes in the ink resistance only between the first and second electrodes.

DETAILED DESCRIPTION OF THE EMBODIMENTS

Figure 1:
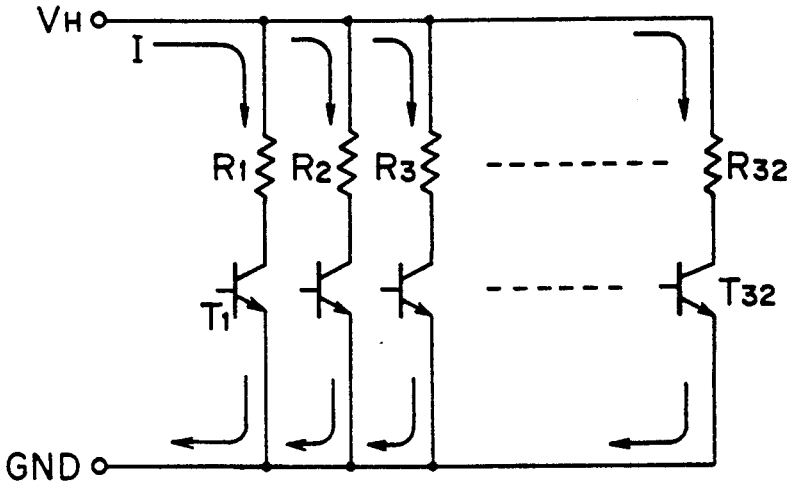
FIG. 1 is a circuit diagram of an example of an ink jet recording head driving circuit.
Figure 2:
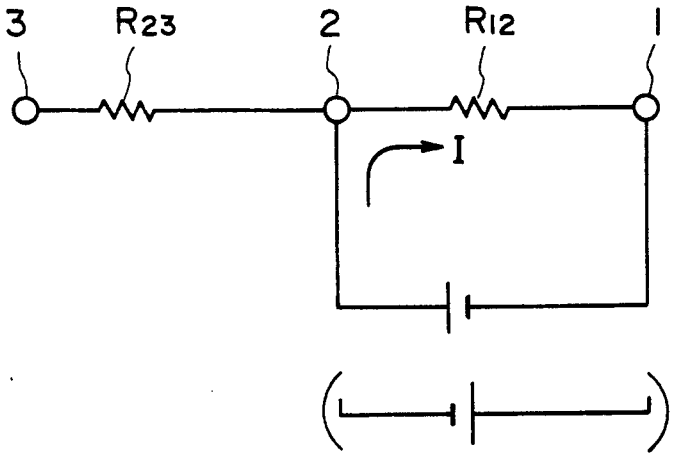
FIG. 2 is a circuit diagram of an equivalent circuit with electrical characteristics equivalent to those of a conventional remaining ink detecting device.
Figure 3:
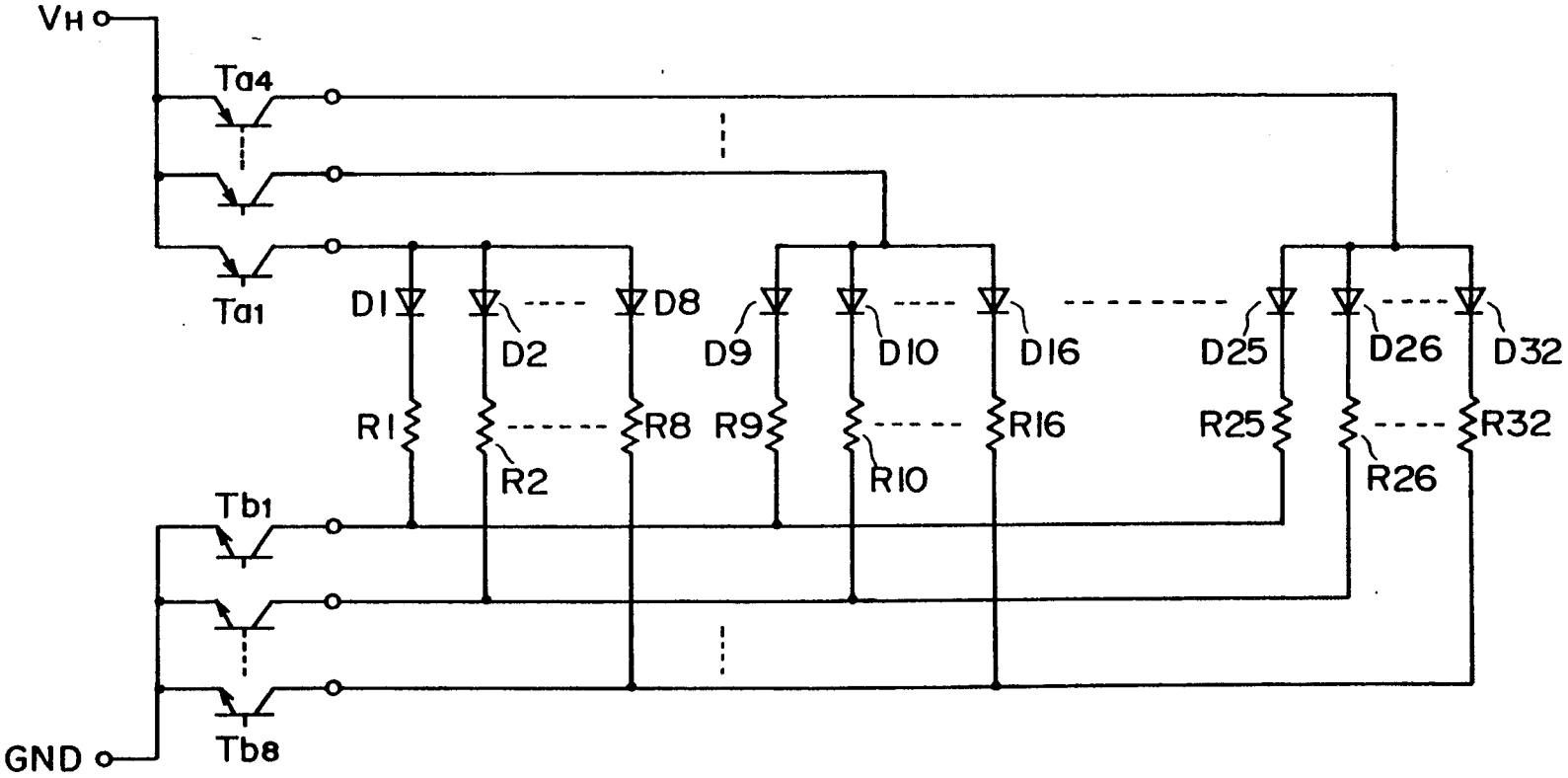
FIG. 3 is a circuit diagram of an example of an ink jet recording head driving circuit of the type which employs the matrix driving method.
Figure 4A:
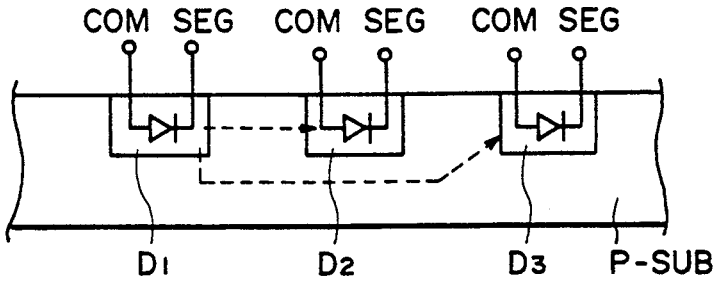
FIGS. 4A and 4B are cross-sectional views of a substrate, schematically illustrating diodes disposed in the matrix driving method.
Figure 4B:
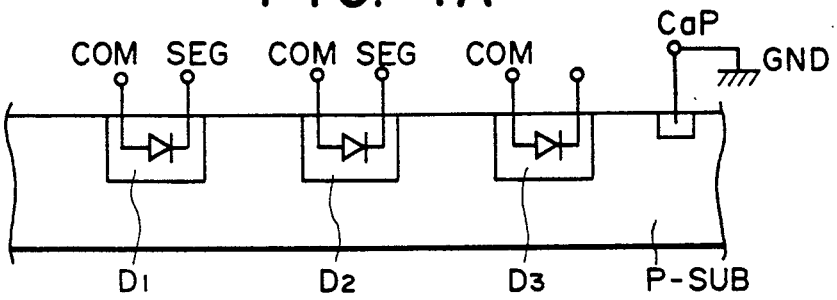
Figure 5:
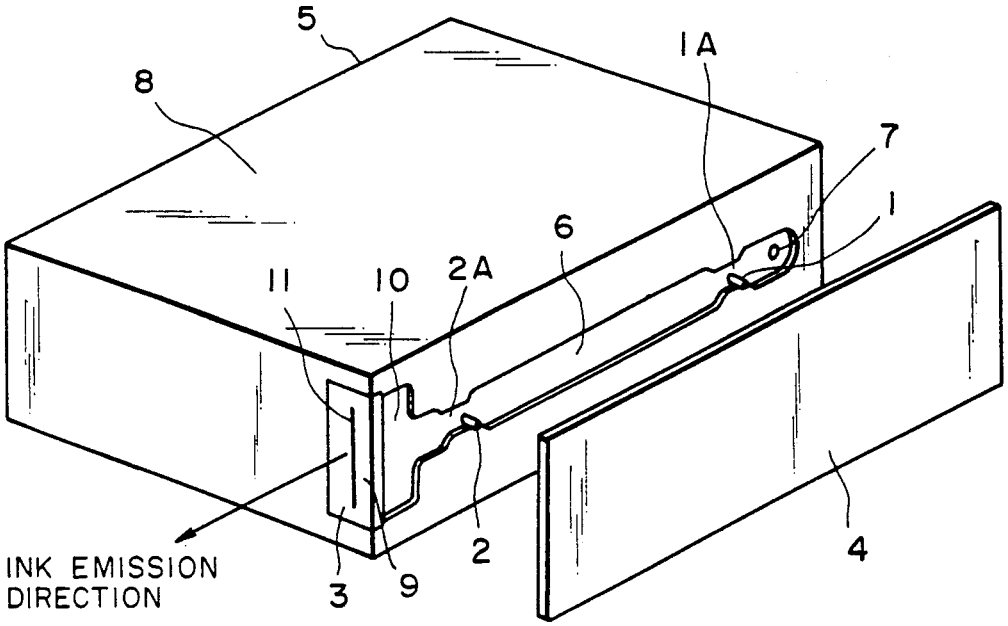
FIG. 5 is a schematic perspective view of an example of an ink jet head cartridge in which an ink tank and a recording head are formed as one unit and to which the remaining ink detecting device according to the present invention is applied.

Embodiments of the present invention will be described below with reference to the accompanying drawings, FIG. 5 is a schematic perspective view of an ink jet head cartridge in which an ink tank portion and a recording head portion are formed as one unit and which incorporates a remaining ink detecting device according to the present invention, This ink jet head cartridge is constructed as a disposable one. A cartridge body 5 has an ink tank portion 8 which is an ink reservoir member, and a recording head portion 9, as shown in FIG. 5. The ink tank portion 8 accommodates an ink reservoir bag for absorbing and storing an ink or an ink absorbing body made of a porous material. The ink stored in the ink tank portion 8 is supplied to the recording head portion 9 from an ink supply port 7, which is an inlet for ink to the recording head portion 9, through an ink supply passage 6.

The recording head portion 9 has a heater substrate 3 on which the electrothermal energy conversion elements and a driving circuit therefor are disposed, and a ceiling plate 4 which forms an ink passageway 10, an ink discharge port 11, the ink supply passage 6 and so on when it is bonded to the side of the heater substrate 3 and that of the ink tank portion 8.

In addition to the ink jet head cartridge shown in FIG. 5 in which the ink supply passage 6, the ink passageway 10 and so on are integrally formed by utilizing the side of the ink tank portion 8, the present invention can also be applied to the type in which a recording head portion 9 is provided separately from the ink tank portion 8 and in which the recording head portion 9 and the ink tank portion 8 are connected to each other by means of the ink supply passage 6. This recording head portion 9 is composed of the heater substrate 3 with the electrothermal energy conversion elements and the driving circuit disposed thereon, and the ceiling plate 4 which is bonded to the heater substrate 3 to form the ink outlet 11 and the ink passageway 10. In that case, the ink outlet 11 may be formed by mounting a plate member with a hole formed therein on the member formed by bonding the heater substrate 3 to the ceiling plate 4 or by forming as one unit the member formed by bonding the heater substrate 3 to the ceiling plate 4 and such a plate member with a hole formed therein.

The present invention can also be applied to a recording head in which an ink passageway is formed by bonding the two members and in which the electrothermal energy conversion elements for generating an emission energy are formed in correspondence with the ink passageway.

In the thus-arranged ink jet head cartridge, electrodes 1 and 2 for detecting the quantity of remaining ink are disposed at a predetermined interval in the ink supply passage 6. The portions of the ink supply passage 6 where the electrodes 1 and 2 are disposed are narrowed to form narrow portions 1A and 2A.

Figure 6:
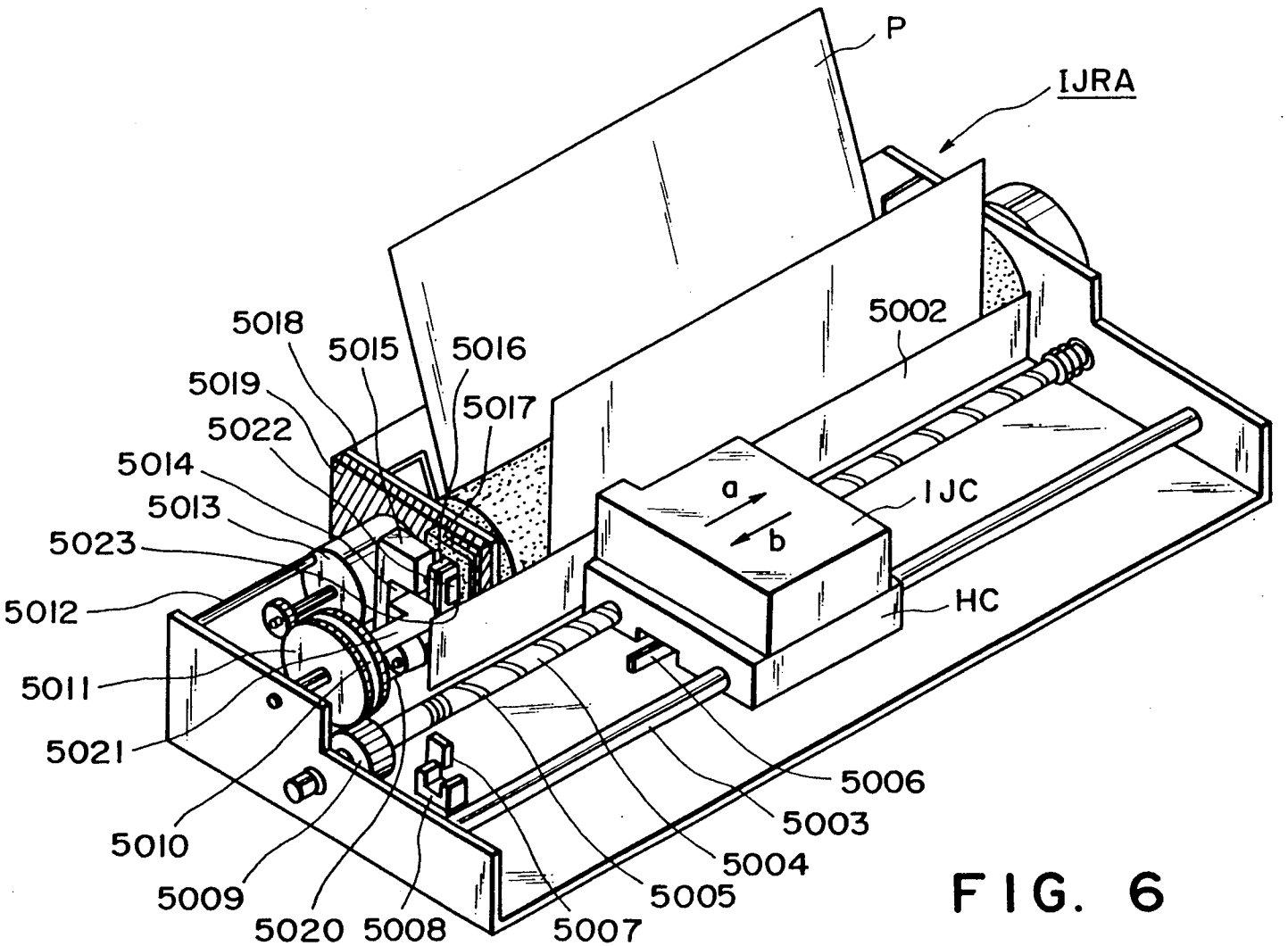
FIG. 6 is a perspective view of an example of an ink jet recording apparatus with the ink jet head cartridge of FIG. 5 mounted thereof.

The above-described cartridge can be mounted on the body of an ink jet recording apparatus such as that shown in FIG. 6 in such a manner that the driving circuit of the heater substrate 3 is connected to the control unit provided in the apparatus through a predetermined connecting portion. When a predetermined recording signal is input to the driving circuit from the control unit, recording is performed to form a desired image. At that time, an ink droplet is emitted as the result of film boiling generated in the ink by utilizing the thermal energy generated by the above-described electrothermal energy conversion elements. A voltage applied ranges from about 15 V to about 25 V. This value can be changed to any value which satisfies the ink emission performance.

FIG. 6 shows an example of an ink jet recording apparatus on which the above-described ink jet head cartridge is mounted to perform recording of a desired image. In this ink jet recording apparatus, the rotational force of a driving motor 5013 is transmitted to a lead screw 5005 through driving force transmission gears 5011 and 5009. A helical groove 5004 formed in the lead screw 5005 is engaged with a carriage HC having a pin (not shown). Rotation of the lead screw 5005 moves the carriage HC in the directions indicated by the arrows a and b. A sheet of paper is pressed against a platen 5000 over the entire range thereof along which the carriage HC is moved by a paper pressing plate 5002. A photocoupler 5007 and 5008 is a home position detecting means which detects the presence of a lever 5006 of the carriage HC. The direction of rotation of the motor 5013 is reversed when the presence of this lever 5006 is detected by the photocoupler. A capping member 5022 for capping the front surface of a recording head is supported by a member 5016. A suction means 5015 for sucking the interior of this cap sucks the recording head through an opening 5023 formed in the capping member. A cleaning blade 5017 is moved toward and away from the recording head by means of a member 5019. Both the moving member 5019 and the cleaning blade 5017 are supported by a supporting plate 5018. The cleaning blade is not limited to that shown in this embodiment, but any of known cleaning blades may be employed. A lever 5012 for starting suction moves as a cam 5020 engaged with the carriage moves. The driving force of the driving motor is transmitted to the lever through a known transmission means such as clutch.

The capping, cleaning and suction processes are performed by means of the action of the lead screw 5005 at corresponding positions when the carriage is returned to its home position area. It may be arranged such that desired operations are performed at a known timing.

Figure 7:
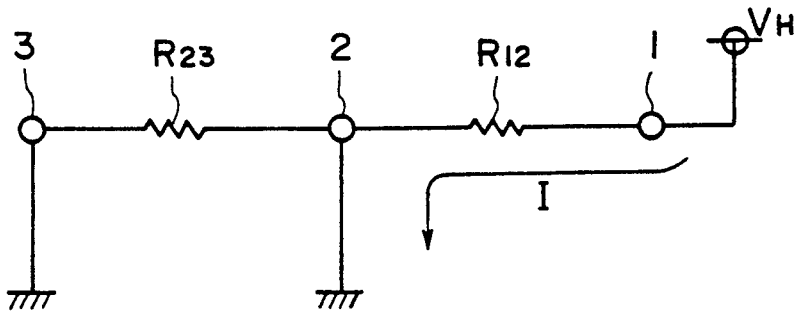
FIG. 7 is a circuit diagram of an example of an equivalent circuit with electrical characteristics equivalent to those of the remaining ink detecting device according to the present invention.

FIG. 7 shows an equivalent circuit with electrical characteristics equivalent to those of the remaining ink detecting device which is made up of the ink supply passage 6, the electrodes 1 and 2 disposed in the ink supply passage 6, and the heater substrate 3.

In the case of a heater substrate 3 which is driven by the matrix driving method, as stated above, the circuit components are deposited at a high density, thus increasing the possibility of a parasitic current flowing between the adjacent diode cells in the diodes $D_1$ to $D_{32}$ disposed on the substrate. Hence, a sub electrode having the same potential as that of the substrate is provided between the diode cells, and this electrode is grounded so as to prevent the parasitic current from flowing into the cells. In this embodiment, since the substrate is P type, it is grounded.

In consequence, the electrode 2 disposed close to the substrate 3 is also grounded, like the substrate 3. The electrode 1 acts as a source electrode for the measurement of an ink resistance.

In this way, the resistance between the substrate 3 and the electrode 2 becomes large, and no leakage current flows between the electrode 1 and the substrate 3, although a current flows between the electrodes 1 and 2. In consequence, the amount of remaining ink can be detected with a high degree of accuracy by measuring the resistance between the electrodes 1 and 2.

The electrode 1 disposed remote from the substrate 3 is at a potential $V_H$, which is different from that of the substrate 3 or electrode 2. In this embodiment, the potential $V_H$ may be set to a value ranging from 15 V to 25 V (constant-voltage measurement).

This potential $V_H$ is substantially equal to the voltage employed to emit an ink droplet in the recording head portion 9. The use of the driving voltage for the recording head eliminates the provision of a voltage source dedicated for the ink level detection device, thereby simplifying the configuration of the recording head portion.

Needless to say, the ink level detection (constant-current measurement) may also be performed by providing a power source other than that for driving the recording head and by applying to the electrode 1 a voltage different from that applied to the recording head.

In this constant-current measurement, the ink resistance between the electrodes 1 and 2 is measured by causing a constant-current to flow from the first electrode toward the second electrode.

Preferably, a current ranging from 1 to 50 mV may be supplied as the constant-current. The voltage of the constant-current source may be set to about 15 V at a maximum.

In a case where the P type Si substrate which is grounded is employed, the electrodes 1 and 2 and the substrate 3 may be disposed such that they satisfy the relation expressed by $R_{1\text{-}3}/R_{1\text{-}2}>5$, where $R_{1\text{-}3}$ is the resistance between the electrode 1 and the substrate 3 and $R_{1\text{-}2}$ is the resistance between the electrodes 1 and 2. In a case where the N type Si substrate having a potential higher than the head driving voltage, as will be described in detail later, is employed, the relation expressed by $R_{2-3}/R_{1-2}>5$ is satisfied, where $R_{2-3}$ is the resistance between the electrode 2 and the substrate 3.

When the resistance $R_{1-3}$ between the electrode 1 and the substrate 3 is sufficiently large as compared with the resistance $R_{1-2}$ between the electrodes 1 and 2, it is not necessary for the electrode 2 to be disposed close to the substrate.

An ink resistance $R_{1-2}$ exists between the electrodes 1 and 2 due to the presence of ink in the ink supply passage 6, and an ink resistance $R_{2-3}$ exists between the electrode 2 and the substrate 3 due to the presence of the ink.

As stated above, the current detected by the remaining ink detecting device according to the present invention is determined only by the current which flows from the electrode 1 to the electrode 2, because the electrode 2 and the substrate 3 are at the same potential and therefore no current flows between the electrode 2 and the substrate 3. In consequence, detection is not affected by the variations in the current caused by the unstable flow of ink between the electrode 2 and the substrate 3, and stable and accurate ink detection is therefore enabled.

Figure 8:
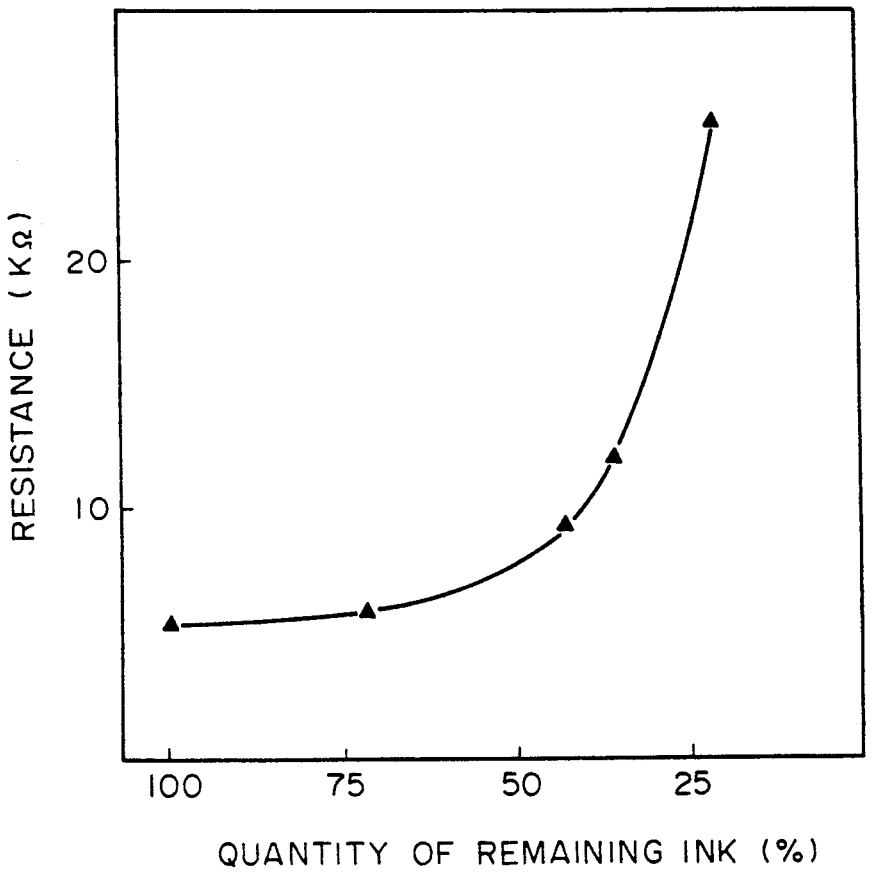
FIG. 8 is a graph, showing a relation between the quantity of remaining ink and resistance detected.

FIG. 8 is a graph, showing the relation between the ink resistance and the amount of remaining ink. A desired curve can be obtained by adjusting the positional arrangement of the electrodes 1 and 2. It is therefore possible to detect a smaller quantity of ink.

Figure 9:
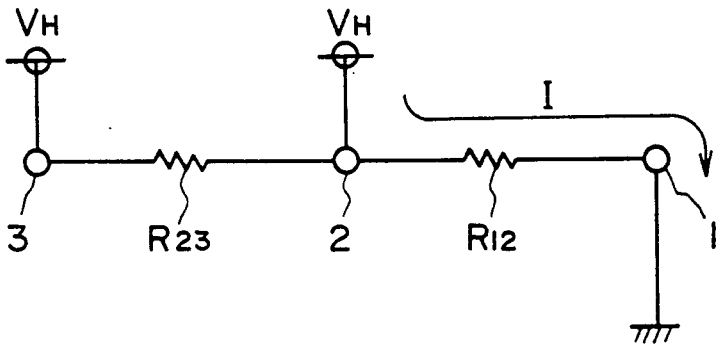
FIG. 9 is a circuit diagram of another example of an equivalent circuit with electrical characteristics equivalent to those of the remaining ink detecting device according to the present invention.

FIG. 9 shows another example of the equivalent circuit shown in FIG. 7. In this example, the heater substrate 3 is of N type, and is therefore maintained at a predetermined potential, e.g., at a potential $V_H$ necessary to drive the electrothermal energy conversion elements. As a result, the electrode 2 is maintained at a potential $V_H$, and the electrode 1 is grounded. In this circuit configuration, since the substrate 3 and the electrode 2 are at the same potential, as in the case of the equivalent circuit shown in FIG. 7, no current flows therebetween. A current flows only between the electrodes 1 and 2, and this current can be detected, resulting in stable and accurate detection of the amount of remaining ink. This example exhibits the same voltage characteristics as those of the aforementioned example which employ the P type substrate.

Figure 10:
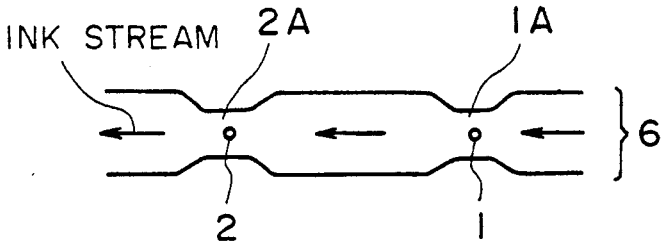
FIG. 10 is a schematic view of an example of an ink supply passage in which the electrodes of the ink level detecting device according to the present invention are disposed.

FIG. 10 schematically shows part of the ink supply passage 6 shown in FIG. 5. As shown in FIG. 10, the portions of the ink supply passage 6 where the electrodes 1 and 2 are provided are narrowed to form narrowed portions 1A and 2A. In consequence, a stream of ink flows at a higher speed at these narrowed portions, thereby removing bubbles or the like from the electrodes. As a result, the adverse effects of the bubbles attached to the electrodes on the detection of the resistance can be eliminated, and the current which flows between the electrodes 1 and 2 can be detected with a high degree of accuracy.

In the above description, no means for detecting the resistance between the electrodes 1 and 2 is shown. However, any known resistance detection means may be employed.

When the amount of remaining ink is to be detected, the resistance between the electrodes 1 and 2 may be measured by applying constant-current or constant-voltage.

The present invention is particularly suitable for use in ink jet recording heads or ink jet recording apparatuses which adopt the bubble jet method.

Such ink jet recording heads or ink jet recording apparatuses are described in the specifications of, for example, U.S. Pat. Nos. 4,723,129, 4,740,706. These apparatuses employ the basic principle of the ink jet recording method, and the present invention is therefore preferably applied thereto. Although this bubble jet method can be applied to both on-demand type and continuance type, it is preferable for it to be applied to the on-demand type. One reason for this is because in the on-demand type recording head, at least one driving signal is applied in response to the information to be recorded to each of the electrothermal energy conversion elements which are disposed in such a manner as to face both the sheet in which the liquid (ink) is held and the liquid passage so as to generate thermal energy in the corresponding electrothermal energy conversion element thereby causing film boiling to occur on the surface of the recording head. A second reason is that a bubble may therefore be formed in the liquid (ink) for each driving signal applied. The liquid (ink) is emitted from the outlet as the bubble grows and contracts to form at least one droplet. When the driving signal has a pulse-like form, growth and contraction of a bubble may be adequately performed, and liquid (ink) can therefore be emitted with excellent response. Driving of the recording head by means of a pulse-like signal has been proposed in the specification of, for example, U.S. Pat. Nos. 4,463,359 and 4,345,262. If the condition regarding the increase in the temperature of the heat acting surface of the recording head, which is described in the specification of U.S. Pat. No. 4,313,124, is adopted, excellent recording is possible.

The recording head according to the present invention may be of several types, one in which the outlets, the liquid passages and the electrothermal energy conversion elements are provided in one-to-one correspondence (linear or bending liquid passages), like those disclosed in the aforementioned specifications. Another is a type in which the heat acting surface is disposed in a bending area, like those disclosed in the specifications of U.S. Pat. Nos. 4,558,333 and 4,459,600. Another is of the type in which a slit is formed as the common outlet for a plurality of electrothermal energy conversion elements, like that disclosed in the specification of Japanese Patent Laid-Open No. 59-123670. Finally a type in which an opening for absorbing the pressure wave of the thermal energy is formed for each outlet, like that disclosed in the specification of Japanese Patent Laid-Open No. 59-138461.

The recording head according to the present invention may also be a chip type which is exchangeable, which can be electrically connected to the body and to which an ink can be supplied from the body when it is mounted on the body, or a cartridge type which is formed as one recording head.

Preferably, the ink jet recording apparatus according to the present invention incorporates various recording head restoring means and various auxiliary means for the purpose of providing stable recording. Such means include a capping means, a cleaning means and pressurizing or suction means for the recording head, a preliminary heating means which employs the electrothermal energy conversion elements, another heating elements or combinations of electrothermal energy conversion elements and another heating elements, and a preliminary emission means for performing emission other than that conducted for recording an image.

Furthermore, the ink jet recording apparatus according to the present invention may be one in which an image is recorded in one main color which may be black, or one in which an image can be recorded in a plurality of different colors or in a full color. Color recording may be achieved by employing a recording head which contains a plurality of colors or a plurality of recording heads which contain respective colors.

Based on the foregoing description of the present invention, since the heater substrate and the second electrode disposed close to the heater substrate are at the same potential, changes in the resistance detected between the first and second electrodes only represent changes in the ink resistance between the first and second electrodes. As a result, a remaining ink detecting device according to the present invention is capable of detecting the amount of remaining ink with a high degree of accuracy by only measuring the resistance between the first and second electrodes.

Furthermore, since the portions of the ink supply passage where the electrodes are disposed are narrowed, attachment of bubbles on the electrodes can be prevented. This enables stable detection of the quantity of remaining ink which represents the actual quantity.

The ink jet heat cartridge according to the present invention is therefore capable of stably and accurately detecting the quantity of remaining ink and thereby of eliminating failures during the emission of ink droplets caused by the absence of ink.

The ink jet recording apparatus according to the present invention therefore incorporates the ink jet heat cartridge enabling exhibition of such excellent characteristics.

What is claimed is:

1. A device for detecting a quantity of remaining ink, comprising:

first and second electrodes provided in an ink supply passage which connects an ink tank for storing an ink to a recording head for emitting the ink; and a detection means for detecting a resistance between said first and second electrodes, wherein said second of said electrode is provided in said ink supply passage in an area relatively close to said recording head, whereas said first of said electrode is provided in said ink supply passage in an area relatively far from said recording head with said second of said electrodes therebetween, and wherein said second of said electrodes is maintained at a same potential as that of a substrate which constitutes said recording head and on which emission energy generating elements driven to emit the ink are disposed, whereas said first of said electrodes is maintained at a potential different from that of said second of said electrode so as to allow an amount of remaining ink to be detected by the measurement of changes in the resistance between said first and second electrodes.

2. An ink jet head cartridge according to claim 1, wherein said substrate is a semiconductive P type substrate, and wherein both said substrate and said second of said electrodes are grounded, whereas said first of said electrodes is set to a predetermined potential of $V_H$.

3. An ink jet head cartridge according to claim 2, wherein a resistance $R_{1-2}$ between said first and second electrodes and a resistance $R_{1-3}$ between said first of said electrodes and said substrate have a relation expressed by $R_{1-3}/R_{1-2}>5$.

4. An ink jet head cartridge according to claim 1, wherein said substrate is a semiconductive N type substrate, and wherein both said substrate and said second of said electrodes are set to a predetermined potential of $V_H$, whereas said first electrode is grounded.

5. A device for detecting a quantity of remaining ink according to claim 4, wherein a resistance $R_{1-2}$ between said first and second electrodes and a resistance $R_{2-3}$ between said second of said electrodes and said substrate have a relation expressed by $R_{2-3}/R_{1-2}>5$.

6. A device for detecting a quantity of remaining ink according to claim 2, wherein the potential $V_H$ of said first electrode is substantially the same as the driving voltage for said recording head, which ranges from 15 V to 25 V.

7. A device for detecting a quantity of remaining ink according to claim 4, wherein the potential $V_H$ of said substrate and said second of said electrodes is substantially the same as the driving voltage for said recording head, which ranges from 15 V to 25 V.

8. A device for detecting a quantity of remaining ink according to claim 1, wherein portions of said ink supply passage where said first and second electrodes are disposed form narrowed portions where the cross-section of said ink supply passage is reduced.

9. An ink jet head cartridge comprising:

a recording head portion composed of a substrate on which ink emission energy generating elements are disposed;

an ink tank portion for storing an ink to be supplied to said recording head portion;

an ink supply passage through which the ink is supplied from said ink tank portion to said recording head portion; and a residual ink detecting means, part of which is provided in said ink supply passage for detecting the amount of remaining ink, wherein said residual ink detecting means includes first and second electrodes and a detecting means for detecting a resistance between said electrodes, wherein said second of said electrodes is provided in said ink supply passage in an area relatively close to said recording head portion, whereas said first of said electrodes is provided in said ink supply passage in an area relatively far from said recording head with said second of said electrodes therebetween, and wherein said second of said electrodes is maintained at a same potential as that of said substrate, whereas said first of said electrodes is maintained at a potential different from that of said of said second electrodes.

10. An ink jet head cartridge according to claim 9, wherein said substrate is a semiconductive P type substrate, and wherein both said substrate and said second of said electrodes are grounded, whereas said first of said electrodes is set to a predetermined potential of $V_H$, which is substantially the same as a driving voltage for said recording head, and which ranges from 15 V to 25 V.

11. An ink jet head cartridge according to claim 9, wherein said substrate is a semiconductive N type substrate, and wherein both said substrate and said second of said electrodes are set to a predetermined potential of $V_H$, which is substantially the same as the driving voltage for said recording head, and which ranges from 15 V to 25 V, whereas said first of said electrodes is grounded.

12. An ink jet head cartridge according to claim 9, wherein portions of said ink supply passage where said electrodes are disposed form narrowed portions where the cross-section of said ink supply passage is reduced.

13. An ink jet head cartridge according to claim 9, wherein said ink emission energy generating elements incorporated in said recording head are electrothermal energy conversion elements for generating thermal energy whose thermal energy is utilized to emit an ink droplet.

14. An ink jet recording apparatus comprising:

an ink jet head cartridge including a recording head portion composed of a substrate on which ink emission energy generating elements are disposed, an ink tank portion for storing an ink to be supplied to said recording head portion, an ink supply passage through which the ink is supplied from said ink tank portion to said recording head portion, and first and second electrodes provided in said ink supply passage for detecting the amount of remaining ink, said second of said electrodes being provided in said ink supply passage in an area relatively close to said recording head portion, whereas said first of said electrodes being provided in said ink supply passage in an area relatively far from said recording head with said second of said electrodes therebetween, and said second of said electrodes being maintained at a same potential as that of said substrate, whereas said first of said electrodes being maintained at a potential different from that of said second of said electrodes;

a means for detecting a resistance between said first and second electrodes; and a carriage provided in such a manner as to be movable with said ink jet head cartridge mounted thereon.

15. An ink jet recording apparatus according to claim 14, wherein said substrate is a semiconductive P type substrate, and wherein both said substrate and said second of said electrodes are grounded, whereas said first of said electrodes is set to a predetermined potential of $V_H$, which is substantially the same as a driving voltage for said recording head, and which ranges from 15 V to 25 V.

16. An ink jet recording apparatus according to claim 14, wherein said substrate is a semiconductive N type substrate, and wherein both said substrate and said second of said electrodes are set to a predetermined potential of $V_H$, which is substantially the same as a driving voltage for said recording head, and which ranges from 15 V to 25 V, whereas said first of said electrodes is grounded.

17. An ink jet recording apparatus according to claim 14, wherein portions of said ink supply passage where said electrodes are disposed form narrowed portions where the cross-section of said ink supply passage is reduced.

18. An ink jet recording apparatus according to claim 14, wherein said ink emission energy generating elements incorporated in said recording head are electrothermal energy conversion elements for generating thermal energy whose thermal energy is utilized to emit an ink droplet.

19. A device for detecting a quantity of remaining ink, comprising:

first and second electrodes provided in an ink supply passage which connects an ink tank for storing an ink to a recording head for emitting the ink; and a detection means for detecting a resistance between said first and second electrodes, wherein said first and second electrodes are disposed such that a resistance $R_{1-3}$ between said first of said electrodes having a potential different from that of a substrate which constitutes said recording head and said substrate is sufficiently larger than an ink resistance $R_{1-2}$ between said first and second electrodes which is obtained when the ink is filled therebetween, and that the resistances $R_{1-3}$ and $R_{1-2}$ have a relation expressed by $R_{1-3}/R_{1-2}>5$, so as to allow the amount of remaining ink to be detected by a measurement of only changes in the resistance between said first and second electrodes.

20. A device for detecting a quantity of remaining ink, comprising:

first and second electrodes provided in an ink supply passage which connects an ink tank for storing an ink to a recording head for emitting the ink; and a detection means for detecting a resistance between said first and second electrodes, wherein said first and second electrodes are disposed in said ink supply passage such that a resistance $R_{1-3}$ between said first of said electrodes having a potential different from that of a substrate which constitutes said recording head and said substrate is sufficiently larger than an ink resistance $R_{1-2}$ between said first and second electrodes which is obtained when the ink is filled therebetween, and that the resistances $R_{1-3}$ and $R_{1-2}$ have a relation expressed by $R_{1-3}/R_{1-2}>5$, so as to allow the amount of remaining ink to be detected by a measurement of only changes in the resistance between said first and second electrodes.

21. An ink jet recording apparatus comprising:

an ink jet head cartridge including a recording head portion composed of a substrate on which ink emission energy generating elements are disposed, an ink tank portion for storing an ink to be supplied to said recording head portion, an ink supply passage through which the ink is supplied from said ink tank portion to said recording head portion, and first and second electrodes provided in said ink supply passage for detecting the amount of remaining ink, said first and second electrodes being disposed in said ink flow passage such that a resistance $R_{1-3}$ between said first of said electrodes having a potential different from that of a substrate which constitutes said recording head and said substrate is sufficiently larger than an ink resistance $R_{1-2}$ between said first and second electrodes which is obtained when the ink is filled therebetween, and that the resistances $R_{1-3}$ and $R_{1-2}$ have a relation expressed by $R_{1-3}/R_{1-2}>5$, so as to allow the amount of remaining ink to be detected by a measurement of only changes in the resistance between said first and second electrodes; and a carriage provided in such a manner as to be movable with said ink jet head cartridge mounted thereon.

22. A device for detecting a quantity of remaining ink, comprising:

first and second electrodes provided at a region for storing ink to be supplied to a recording head for ink emission; and measurement means for measuring an electric property change between said first and second electrodes obtained as a result of applying a predetermined electric signal between said first and second electrodes, wherein one of said first and second electrodes is said recording head and is maintained at substantially a same potential as a supporting member supporting an energy generating element to be driven for ink emission, and the other of said first and second electrodes is maintained at a potential different from said one of said first and second electrodes.

23. An ink jet cartridge removably held on a recording device, comprising:

a recording head section for ink emission;

a tank section for storing ink to be supplied to said recording head; and first and second electrodes provided within a region in which ink exists between said tank section and said recording head section, wherein one of said first and second electrodes is said recording head section and is maintained at a same potential as a supporting member supporting an energy generating element to be driven for ink emission, and the other of said first and second electrodes is maintained at a potential different from said one of said first and second electrodes, and wherein said ink jet cartridge detects the quantity of the ink remaining within said tank section, based on measurement of an electric property between said first and second electrodes by said measurement means, responsive to applying an electric signal between said first and second electrodes when said cartridge is mounted on said recording device.

* * * * *

UNITED STATES PATENT AND TRADEMARK OFFICE

CERTIFICATE OF CORRECTION

PATENT NO. : 5,329,304

DATED : July 12, 1994

INVENTOR(S) : RYOICHI KOIZUMI, ET AL.

It is certified that error appears in the above-identified patent and that said Letters Patent is hereby corrected as shown below:

COLUMN 1

Line 6, "Nov. 7, 1991," should read --Mar. 7, 1991,--.

COLUMN 2

Line 8, "$R_{2-3}$representing" should read --$R_{2-3}$ representing--.

COLUMN 3

Line 1, "a N type" should read --an N type--.
Line 7, "$R_{2-3}$affects" should read --$R_{2-3}$ affects--.

COLUMN 4

Line 64, "$R_{1-2}$between" should read --$R_{1-2}$ between--.

COLUMN 6

Line 17, "thereof;" should read --thereon;--.

COLUMN 10

Line 6, "continuance" should read --continuous--.
Line 61, "another" should read --other--.
Line 63, "another" should read --other--.

COLUMN 11

Line 39, "electrode" should read --electrodes--.
Line 42, "trode" should read --trodes--.
Line 51, "electrode" should read --electrodes--.

UNITED STATES PATENT AND TRADEMARK OFFICE

CERTIFICATE OF CORRECTION

PATENT NO. : 5,329,304

DATED : July 12, 1994

INVENTOR(S) : RYOICHI KOIZUMI, ET AL.

It is certified that error appears in the above-identified patent and that said Letters Patent is hereby corrected as shown below:

COLUMN 11

Line 56, "An ink jet head cartridge" should read --A device for detecting a quantity of remaining ink--.
Line 61, "An ink jet head cartridge" should read --A device for detecting a quantity of remaining ink--.
Line 66, "An ink jet head cartridge" should read --A device for detecting a quantity of remaining ink--.

COLUMN 12

Line 9, "$V_H$of" should read --$V_H$ of--.
Line 10, "electrode" should read --of said electrodes--.
Line 48, "of said second" should read --second of said--.
Line 61, "the" (second occurrence) should read --a--.

Signed and Sealed this

Thirteenth Day of December, 1994

Bruce Lehman

*Attest:*

BRUCE LEHMAN

*Attesting Officer*

*Commissioner of Patents and Trademarks*